United States Patent [19]

McGreehan

[11] Patent Number: 4,893,983

[45] Date of Patent: Jan. 16, 1990

[54] CLEARANCE CONTROL SYSTEM

[75] Inventor: William F. McGreehan, Westchester, Ohio

[73] Assignee: General Electric Company, Cincinnati, Ohio

[21] Appl. No.: 178,734

[22] Filed: Apr. 7, 1988

[51] Int. Cl.[4] ..... F01D 17/00

[52] U.S. Cl. ..... 415/48; 415/116; 60/39.29

[58] Field of Search ..... 415/47.48.14.110, 116.175, 415/176; 60/39.29

[56] References Cited

U.S. PATENT DOCUMENTS

| | | | |
|---|---|---|---|
| 3,647,313 | 3/1972 | Koff | 415/115 |
| 3,742,706 | 7/1973 | Klompas | 60/757 |
| 3,844,110 | 10/1974 | Widlansky | 60/39.08 |
| 4,069,662 | 1/1978 | Redinger, Jr. et al. | 60/226 |
| 4,117,669 | 10/1978 | Heller | 415/116 |
| 4,127,988 | 12/1978 | Becker | 60/757 |
| 4,213,738 | 7/1980 | Williams | 416/95 |
| 4,217,755 | 8/1980 | Williams | 415/116 |
| 4,230,436 | 10/1980 | Davison | 415/1 |
| 4,242,042 | 12/1980 | Schwarz | 415/116 |
| 4,268,221 | 5/1981 | Monsarrat et al. | 415/116 |
| 4,329,114 | 5/1982 | Johnston et al. | 415/145 |
| 4,487,016 | 12/1984 | Schwarz et al. | 60/204 |
| 4,576,547 | 3/1986 | Weiner | 415/116 |
| 4,581,887 | 4/1986 | Scheffler et al. | 415/116 |
| 4,648,241 | 3/1987 | Putman | 60/39.29 |
| 4,741,153 | 5/1988 | Hallinger et al. | 415/116 |

OTHER PUBLICATIONS

CF6 Jet Engine Diagnostics Program, by M. A. Radomski, Jan. 1982, CFM56-5 Technical Review-Oct., 1986.

*Primary Examiner*—Robert E. Garrett
*Assistant Examiner*—John T. Kwon
*Attorney, Agent, or Firm*—Derek P. Lawrence; Nathan D. Herkamp

[57] ABSTRACT

A method and system for controlling rotor blade tip clearances in a gas turbine engine is disclosed. A flow of heat transfer fluid is supplied to the rotor. The temperature of the flow is controlled as a function of the heat carrying capacity of the fluid.

12 Claims, 3 Drawing Sheets

CLEARANCE CONTROL SYSTEM

The present invention is an improved control system for varying clearances in a gas turbine engine by selectively heating or cooling the engine rotor.

BACKGROUND OF THE INVENTION

This application is related to application Ser. No. 178,721, pending filed concurrently herewith.

Gas turbine engines typically include a core engine with a compressor for compressing air entering the core engine, a combustor where fuel is mixed with the compressed air and then burned to create a high energy gas stream, and a first turbine which extracts energy from the gas stream to drive the compressor. In aircraft turbofan engines a second turbine or low pressure turbine located downstream from the core engine extracts more energy from the gas stream for driving a fan. The fan provides the main propulsive thrust generated by the engine.

The rotating engine components of the turbine and compressor include a number of blades attached to a disc which are surrounded by a stationary shroud. In order to maintain engine efficiency, it is desirable to keep the space or gap between the tips of the blades and the shroud to a minimum. If the engine were to operate only under steady state conditions, establishing and maintaining a small gap would be fairly straight forward. However, normal operation of aircraft gas turbine engines involves numerous transient conditions which may involve changes in rotor speed and temperature. For example, during takeoff rotor speed and temperature are high which means that there is a correspondingly high radial expansion of the blades and disc. Similarly, during decreases in engine rotor speed and temperature there is a reduction in the radial size of the blades and disc. The stationary shroud also expands or contracts in response to changes in temperature.

It is difficult to devise a passive system in which the blades and disc move radially at the same rate as the shroud so as to maintain a uniform gap therebetween. This is due in part to the fact that the rotor grows elastically almost instantaneously in response to changes in rotor speed with essentially no corresponding shroud growth. Furthermore, there is a difference in the rate of thermally induced growth between the shroud and rotor. Typically, the thermal growth of the rotor blades lags the elastic growth, and thermal growth of the shroud lags blade thermal growth with disc thermal growth having the slowest response of all.

In the past, various active systems have been employed to control the relative growth between the shroud and rotor and thereby control the gap, for example, selectively heating and/or cooling the stator shroud such as disclosed in U.S. Pat. No. 4,230,436, Davison.

A proposal for controlling clearances in a compressor by selectively heating its rotor is disclosed in U.S. Pat. No. 4,576,547, Weiner. The system disclosed therein shows two sources of relatively high pressure compressor air at different temperatures being selectively admitted into the rotor bore at a mid stage station of the compressor. Control of clearances by continuously cooling a rotor is disclosed in U.S. Pat. No. 3,647,313, Koff.

As a further consideration, not only must an active system have the inherent capability to vary the clearance between the blade tip and surrounding shroud, but the control logic must accurately predict the clearance and send a signal to the means employed to vary the clearance.

An example of control logic used in a prior clearance control system is disclosed in U.S. Pat. No. 4,230,436—Davison. Davison controls two sources of air as a function of timing and engine speed. Other systems have also utilized engine speed as a control parameter. For example, U.S. Pat. No. 4,069,662—Redinger turns shroud cooling air on at a predetermined engine speed and altitude.

In a system where air temperature or flow can be more fully modulated more complex control logic may be required.

OBJECTS OF THE INVENTION

It is an object of the present invention to provide a new and improved system for controlling the temperature of a rotor of a turbomachine.

It is another object of the present invention to provide a new and improved control system for varying blade tip to shroud clearances in a turbomachine.

It is yet another object of the present invention to provide a new and improved method for controlling the temperature of a turbomachine rotor.

It is a further object of the present invention to provide a new and improved method for predicting an operating parameter within the bore of a turbomachine rotor in order to accurately calculate the required temperature of fluid delivered to the bore for changing blade tip to shroud clearances.

SUMMARY OF THE INVENTION

According to one embodiment, the present invention is a system for controlling the temperature of a rotor of a turbomachine. The system comprises means for supplying a heat transfer fluid flow to the rotor, means for varying the temperature of the flow, and means for varying the flow as a function of the heat carrying capacity of the fluid.

According to another embodiment, the present invention is a method of controlling the temperature of a rotor of a turbomachine rotor. The method includes the step of providing a heat transfer fluid flow ($w_b$) to the rotor, calculating the rotor temperature as a function of $w_b$, determining a desired rotor temperature, and varying the temperature of the heat transfer fluid to attain the desired rotor temperature.

DETAILED DESCRIPTION OF THE INVENTION

Figure 1:
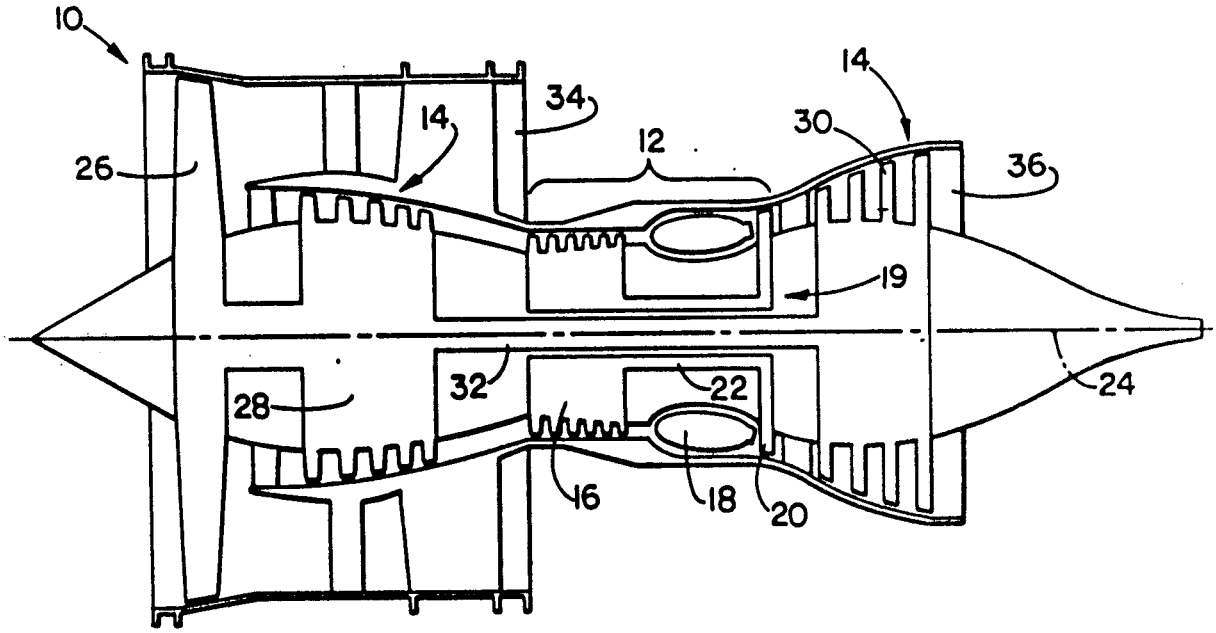
FIG. 1 is a cross sectional schematic view of a gas turbine engine.

FIG. 1 shows a gas turbine engine 10 having a core engine 12 and low pressure system 14. Core engine 12 has an axial flow, high pressure compressor 16, combustor 18 and high pressure turbine 20 in serial flow relationship. Compressor 16 and turbine 20 have rotor sections which are connected by a first shaft 22, which rotate together about engine center line 24. These rotor sections together with shaft 22 and the other rotating elements of core engine 12 comprise rotor 19.

Low pressure system 14 includes a fan 26, axial flow booster compressor 28, and a low pressure turbine 30. As evident from FIG. 1, fan 26 and compressor 28 are located forward of core engine 12 and low pressure turbine 30 is located aft of core engine 12. The rotor sections of the low pressure system components are connected by a second shaft 32 which rotate about engine center line 24.

Air entering core engine 12 first passes through the radially inward portion of fan 26 and through booster compressor 28 where it is compressed thereby increasing its pressure and temperature. The air is further compressed as it moves through high pressure compressor 16. The air is then mixed with fuel in combustor 18 and burned to form a high energy gas stream. This gas stream is expanded through high pressure turbine 20 where energy is extracted to drive compressor 16. More energy is extracted by low pressure turbine 30 for driving fan 26 and booster compressor 28. Engine 10 produces thrust by the fan air which exits fan duct 34 and the gases which exit core nozzle 36.

Figure 2:
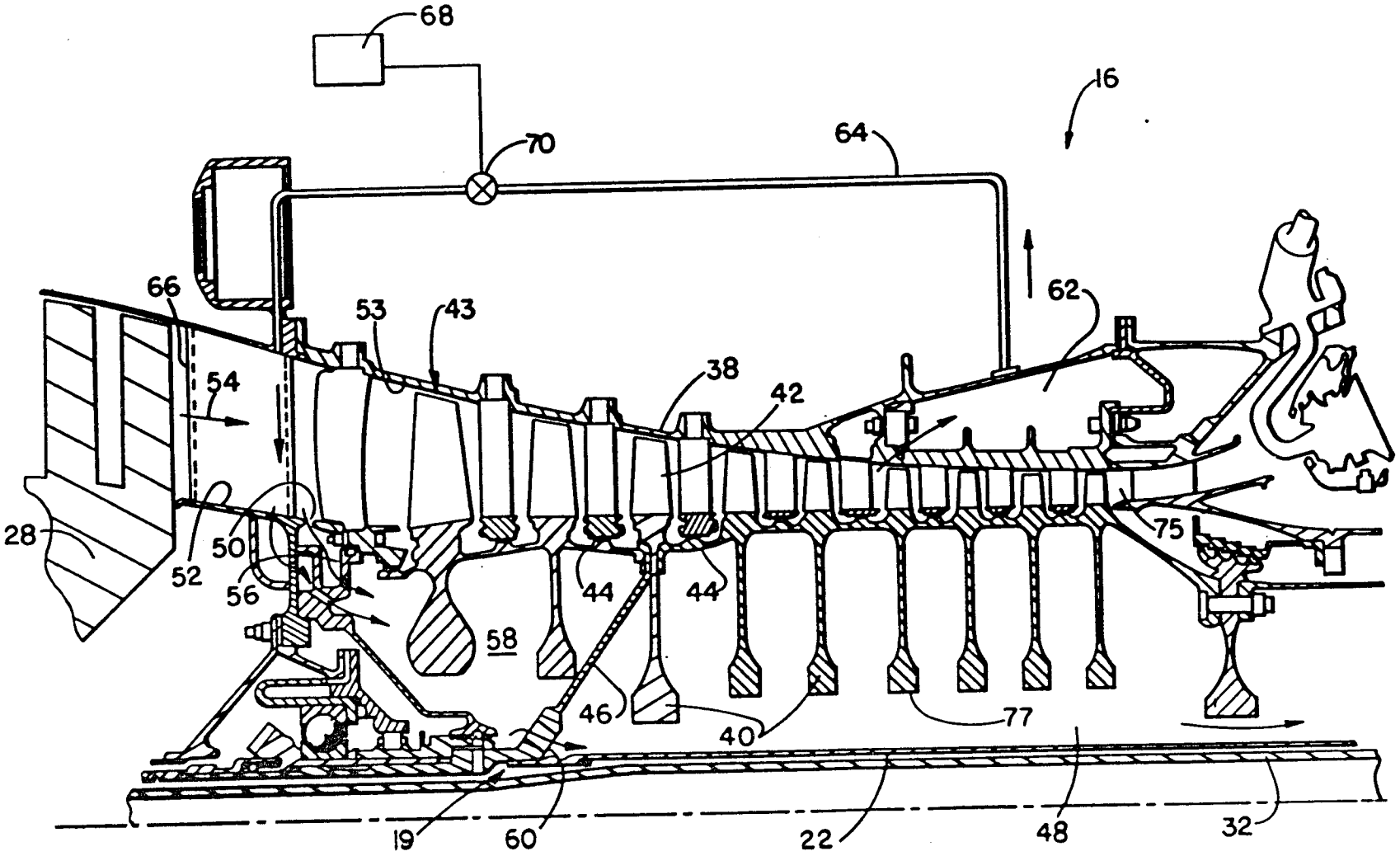
FIG. 2 is a cross sectional schematic view of the high pressure compressor of the engine shown in FIG. 1 which illustrates one form of the present invention.

Referring now to FIG. 2, high pressure compressor 16 has a plurality of discs 40. Each disc 40 supports a plurality of circumferentially spaced compressor blades 42 which define a single compressor stage. The various stages are connected together by members 44 and are connected to tubular shaft 22 by cone or forward support structure 46. These elements of rotor 19 define a rotor bore 48 between shaft 22 and members 44.

Figure 3:
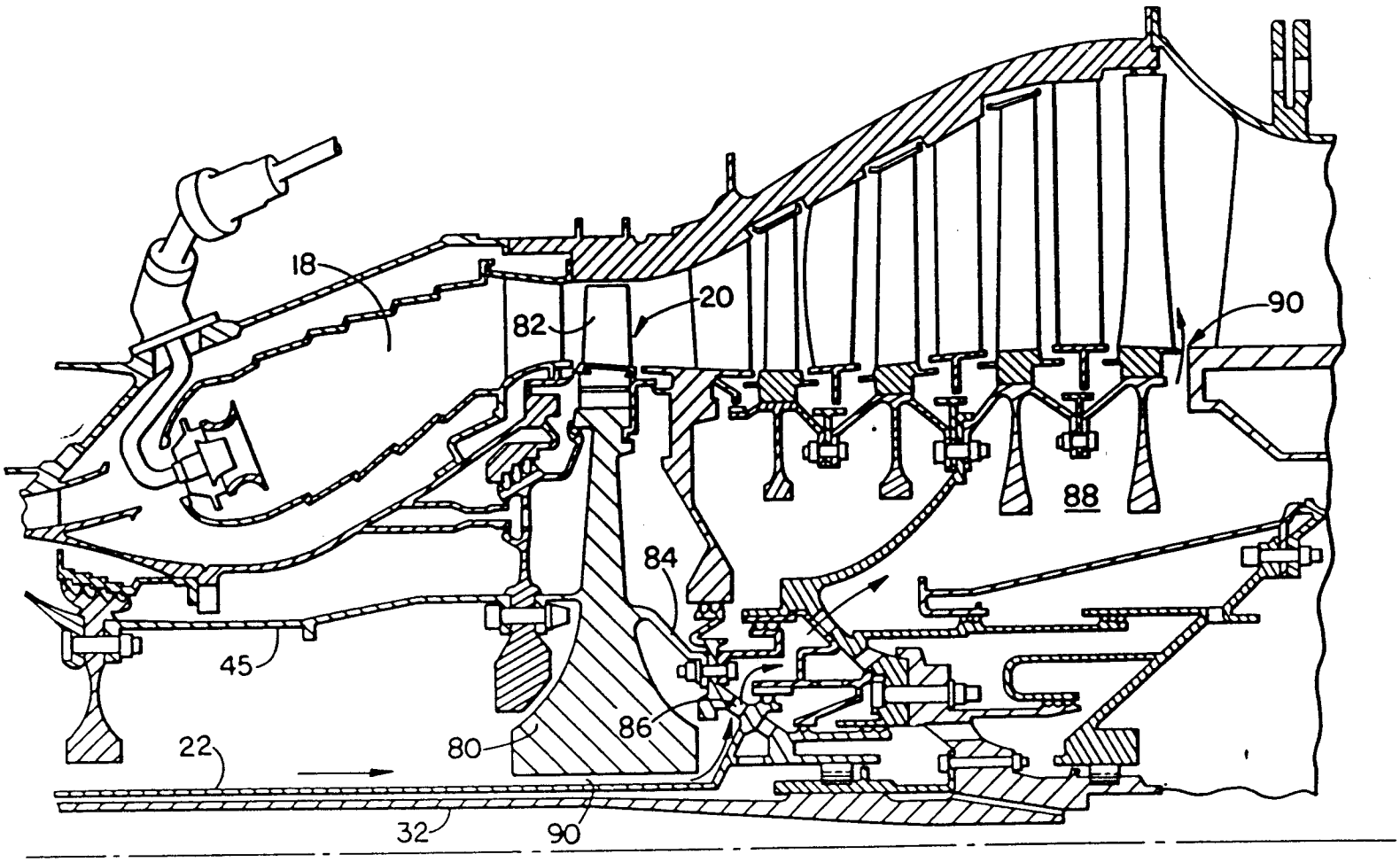
FIG. 3 is a cross sectional schematic view of the high pressure turbine of the engine shown in FIG. 1 which, together with the illustration in FIG. 2, illustrates one form of the present invention.

Referring now to FIG. 3, high pressure turbine 20 includes a disc 80 which supports a plurality of circumferentially spaced turbine blades 82. Disc 80 is connected to the compressor stages by member 45 and is connected to shaft 22 by aft support structure 84.

All of the rotating components of engine 10 are surrounded at their radially outer ends by a stationary shroud structure. For example, as shown in FIG. 2, high pressure compressor 16 is surrounded by shroud 38.

One part of the present invention is a system for maintaining the desired clearance between rotating blades and a surrounding shroud by controlling the temperature of the discs which support the blades. In one form, the system includes means for supplying a cooling fluid to the rotor, means for supplying a heating fluid to the rotor, and means for controlling only the flow of the heating fluid.

In the embodiment of the invention shown in FIGS. 2 and 3, the cooling fluid is air supplied from booster compressor 28. The means for supplying this booster air includes slot 50, manifold 56, common mixing chamber 58 and holes 60. The slot 50 is a preferred form of an opening through which booster bleed air is obtained. Slot 50 is disposed in the radially inner wall 52 of the annular flowpath 54 at a location aft of booster compressor 28 and forward of high pressure compressor 16. Booster air for cooling of rotor 19 is continuously bled through slot 50. The air is collected in manifold 56 (which is preferably less than a 360° structure but which could be a 360° structure in certain embodiments or even a plurality of discrete manifolds) from where it passes into common mixing chamber 58. Mixing chamber 58 is located forward of support structure 46 and at the forward end of rotor 19. Chamber 58 is fluidly connected to rotor bore 48 by a plurality of holes 60 in forward support structure 46.

Still referring to the embodiment of FIGS. 2 and 3, the heating fluid is compressor air bled from an intermediate stage of the high pressure compressor 16. By supplying air from a location aft of the first upstream high pressure compressor stage 43, higher temperature air is thereby obtained. The means for supplying this compressor air includes manifold 62, tube 64, strut 66, common mixing chamber 58 and holes 60. The air is collected in bleed manifold 62 which is radially outwardly disposed with respect to high pressure compressor 16. A tube 64, external to the radially outer wall 53 of flowpath 54, connects bleed manifold 62 to strut 66, strut 66 being located between booster compressor 28 and high pressure compressor 16. When activated, compressor air flows from manifold 62 through tube 64 and hollow strut 66 and into common mixing chamber 58.

Means for controlling the flow of compressor air ($w_h$) includes means for varying $w_h$ and means for controlling the varying means. In the embodiment shown in FIG. 2 the varying means are shown by valve 70 which is controlled by logic means 68. The operation of logic means 68 will be described more fully hereinafter; however, structurally logic means 68 may include a computing device such as a microprocessor or equivalent apparatus as will obvious to those skilled in the art. Valve 70 is disposed within tube 64, and is located radially outward of the engine case for ease of assembly, operation, and maintenance.

In one embodiment, the invention further includes means for restricting the flow of air to the rotor. According to a preferred form of the invention, such restriction means includes a fixed orifice or orifices in the form of metering holes 86 in aft support structure 84.

In operation, booster air is admitted into rotor bore 48 from flowpath 54 through slot 50, manifold 56, mixing chamber 58 and holes 60. The air flows aft and exits bore 48 through metering holes 86. In the disclosed embodiment the discharged air passes through the low pressure turbine bore cavity 88 before reentering the gas flowpath through slot 90. The air flows continuously and there is no valve to control its flow. The presence of this baseline cooling flow minimizes rotor thermal growth at maximum growth conditions. The absence of a valve also enhances the system's reliability and ensures that air will flow into the bore cavity during all engine operating conditions thereby keeping it purged of unwanted vapors. In addition, since the air is bled internally of flowpath 54 there is no external piping required.

The only valve required in the subject invention is valve 70 which controls only the flow of the high pressure air ($w_h$). When valve 70 is closed no heating air and only the relatively cool booster air reaches bore 48. As valve 70 is partially opened and compressor air flows through tube 64, the booster air flow ($w_c$) and $w_h$ mix in chamber 58 forming an air mixture, or total flow ($w_b$), which passes through holes 60 into bore 48. Metering holes 86 in aft support structure 86 are sized so that the flow therethrough is metered, i.e., at the given operating conditions the size of this orifice establishes the flowrate. This means that the proportion of the booster air in the air mixture is reduced when the flow of compressor air is increased. In other words, as the flow of compressor air increases, the flow of booster air will decrease in such a manner that at a given operating condition of the turbomachine the total bore flow remains relatively constant, i.e. $w_b = w_c + w_h$.

As noted, holes 86 are sized so that the flow therethrough is metered. Alternative means for restricting the flow are possible if the sizes of holes 86 in aft support 84 and holes 60 in forward support 46 are adjusted so that holes 60 meter the flow. It is also possible to size the system components so that the flow is metered at yet other locations, for example, annulus 90 between high pressure turbine disc 80 and shaft 22. One advantage of the preferred embodiment is that by having the metering point at the aft end of the rotor bore 48 the pressure in bore 48 is increased thereby achieving improved heat transfer with discs 40.

Various control parameters and logic may be employed to control the setting of valve 70. For example, control parameters may include selected engine operating parameters and/or engine operating conditions. Engine operating parameters may include engine core speed, fan speed, or temperatures or pressures at predetermined engine locations. Engine operating conditions may include altitude, or ambient temperature or pressure. In a preferred embodiment the logic will sense as input both altitude and engine core speed. The valve will be closed at less than 8000 feet to prevent rubs between the blade tips and shrouds during rapid changes in engine speed. Above 8000 feet the valve will be modulated to allow more flow of heating air at lower engine speeds and lower altitude and less flow at higher engine speeds and higher altitudes.

An objective of the control system is to provide a flow of heating air which when mixed with the cooling air and supplied to the rotor bore will provide a sufficient change in the rotor temperature to effect a desired change in the compressor blade tip clearance. Simply stated, this will be achieved by (1) obtaining values of selected rotor bore parameters such as the heat transfer fluid flow ($w_b$), the temperature ($T_{in}$) of $w_b$, and the temperature of the rotor within the bore (T), all at a first operating condition, (2) determining a desired rotor temperature, and (3) varying the temperature of $w_b$ to attain the desired rotor temperature.

According to one form of the present invention, the amount of heating air required to achieve the desired temperature of $w_b$ is determined by first calculating the temperature of the compressor rotor within the bore at a first operating condition. (As used hereinafter the term "rotor" refers to that portion of the rotor within the rotor bore 48, including discs 40, unless the meaning clearly refers to all of the rotating elements of rotor 19.) A conventional way of making this calculation is through the equation:

$$n = (T - T_{in})/(T_{out} - T_{in}) \quad (1)$$

where:

T = rotor temperature, which is defined as the air temperature in the rotor bore at a given location.*

*It should be understood that T is not the actual temperature of the rotor. However, it is convenient to refer to T as the "rotor temperature" since the temperature of discs 40 approach the air temperature at the radially inner radius 77 thereof. Accordingly, the phrase "rotor temperature" is defined as the temperature of the air within the rotor bore.

$T_{in}$ = temperature of heat transfer fluid entering the rotor bore, for example, if valve 70 is turned off, $T_{in}$ = temperature of booster air $T_{out}$ = a reference temperature that reflects the heat input to the rotor, in a preferred embodiment this will be T3 -the temperature at the outlet 75 to compressor 16.

Figure 4:
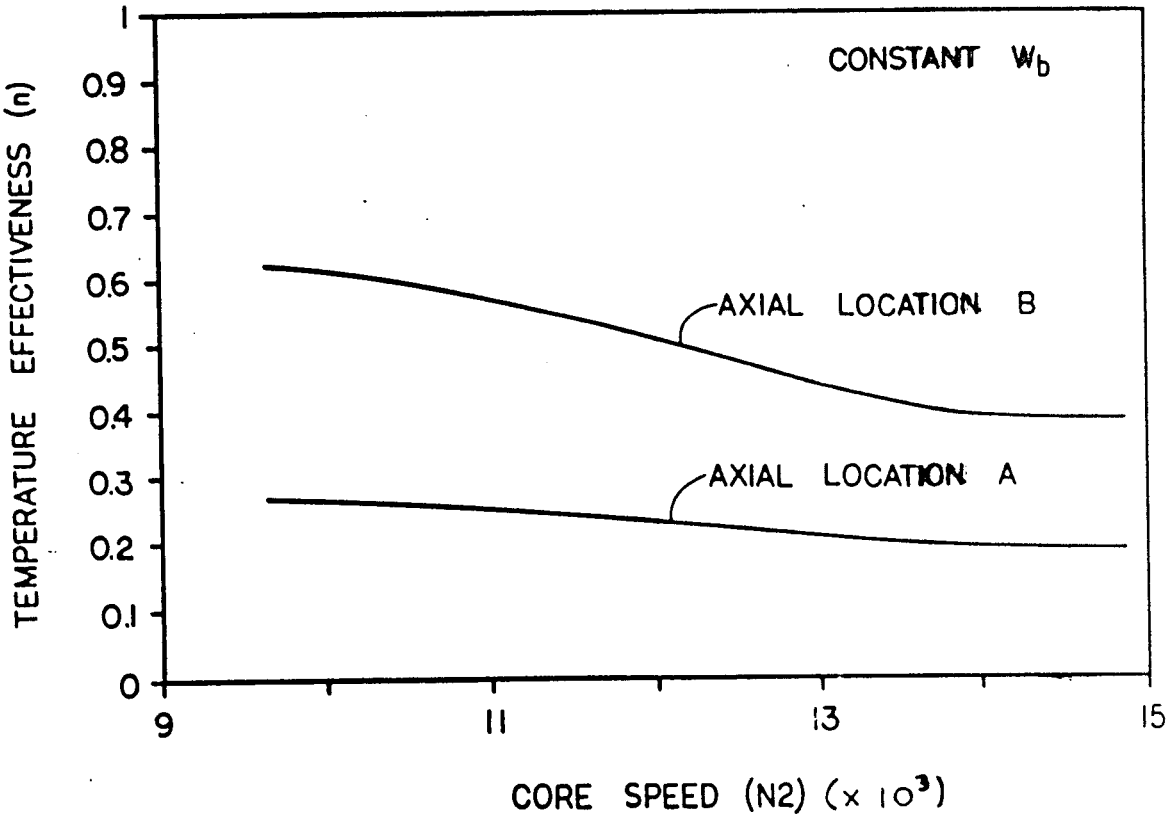
FIG. 4 is a graph of temperature effectiveness vs. engine core speed at different axial locations and for a generally constant mass flow of a bore heat transfer fluid measured as a percentage of mass flow through the core engine.

The value of n will vary with engine rotor speed and typically will be determined empirically during ground testing where the value of T can be obtained by direct measurement. Obviously, T will vary depending on the axial location. In the past, values of n have been determined at specified axial locations as a function of core speed (N2) and % w25, % w25 being the amount of air flow through the bore ($w_b$) expressed as a percent of air flow through the compressor flowpath. FIG. 4 shows a typical graph where values of n at two different axial locations are plotted as a function of N2 for a generally constant % w25. Axial location B will have greater values for n at a given core speed than an upstream location A. For a given core speed N2, $T_{in}$ and T3 are easily calculated so equation (1) may be solved for T.

Normally $T_{in}$ (when booster air only is assumed to be flowing) and T3 for a given N2 are obtained by direct measurement.

In the past, it has been the practice to use equation (1) to predict the value of T at a given altitude. It was believed that as long as % w25 were known, equation (1) would remain valid because the graph shown in FIG. 4 gives a value of n for a given % w25. It was reasoned that the heat transfer relationship between the compressor flowpath and the compressor rotor within the bore would not significantly change as a result of reduced pressure such as occurs with increased altitude.

However, it has been discovered that the prediction of T by this method is inexact at low pressure conditions. More specifically, there appears to be a heretofore unexplained rise in T (relative to its expected value) with increases in altitude. According to the present invention a more accurate method of predicting T at altitude has been devised.

The subject invention contemplates the calculation of T as a function of the actual heat transfer fluid flow ($w_b$) to the rotor. The use of $w_b$ as opposed to the conventional use of % w25 effectively takes into account the the reduced heat carrying capacity of the heat transfer fluid when $w_b$ is reduced. Thus, this aspect of the invention may be viewed as a way of controlling valve 70 as a function of the heat carrying capacity of $w_b$. According to one form of the present invention, T may be calculated by the basic heat transfer equation for rotating drums.

$$N_u = C\, R_x^l Gr^m Pr^y \quad (2)$$

where:

$N_u$ is the average Nusselt number $R_x$ is the axial through flow Reynolds number Gr is the Grashoff number, and Pr the Prandl number The constant C and the exponents l, m, and y are determined experimentally for the given geometry.

The Reynolds number is defined by the equation:

$$R_x = 2 w_b r_b / u A_b \quad (3)$$

where:

$w_b$ is the bore flow rate $r_b$ is the disc bore radius 77 u is the dynamic viscosity of air $A_b$ is the bore through flow area, $A_b = \text{pi } r_b^2$ The Grashof number is defined by the equation:

$$G_r = (pa/u)^2 B(T_s - T_a) r_d^4 \quad (4)$$

where:

p is the air density a is the angular velocity of the rotor determined from N2 ($a = 2 \text{ pi } r_d N2$)

B is the thermal expansion coefficient of air $T_s$ is the drum temperature (here assumed to be T3)

$T_a$ is the average air temperature in the bore, $T_a = (T_{in} + T)/2$ $r_d$ is the drum radius 79

The Prandl number is defined by the equation:

$$P_r = uC_p/k \quad (5)$$

where:

$C_P$ is the specific heat of air k is the thermal conductivity of air

Equations (3), (4), and (5) may each be solved for $R_x$, $G_r$, and $P_r$, respectively.

In order to complete the solution of equation (2), values of C, l, m, and y must be obtained. This is best done by a technique known as linear regression analysis of measured data. Data is first obtained by varying each of the variables $R_x$ and $G_r$. The value of $P_r$ is a constant for air and y has a known quantity of 0.4, The linear regression analysis is a statistical data reduction process which isolates the relationship of $N_u$ to each of the variables $R_x$ and $G_r$ independently. One result of this regression analysis is the value of coefficient C and exponents l and m. Once the values of C, l, m, and y have been obtained, $N_u$ can be calculated from equation (2).

The calculation of $N_u$ by equation (2) compensates for changes in pressure at altitude giving more accurate results than obtained by the solution of equation (1) for T. This is necessary for accurate clearance control during altitude operation.

The value of T is determined from the definition of $N_u$, which when solved for T gives the following equation:

$$T = T_{in} + [N_u k A(T_s - T_a)]/r_d w_b c_p \quad (6)$$

where:

k = air conductivity

A = heat transfer surface area of the rotor drum at radius 79 (2 pi $r_d$L, where L = length of the rotor bore)

$T_s$ = average surface temperature, which can be approximated by T3, the compressor discharge temperature $T_a$ = average bore air temperature, $T_a = (T_{in} + T)/2$ $r_d$ = mean radius of the flow path at 79

$w_b$ = bore flow $C_p$ = specific heat of air

Normally equation (6) will be solved using $T_{in}$ = booster air temperature. In other words, the temperature T of the rotor is calculated based on a flow of booster air only. Having established T for this condition, the amount of fifth stage heating air can be determined. First; however, the desired rotor temperature (T') must be determined. This determination depends on the desired change in blade tip clearance and may be made empirically, or analytically such as by the approximate formula:

$$C_l' = C_l = e(T' - T)(r_d + r_b)/2 \quad (7)$$

where:

e is the coefficient of linear thermal expansion $C_l$ is the clearance at a bore temperature T, and $C_l'$ is the clearance at a bore temperature of T'

As a typical example, a change in T of 250° F. could provide a change in blade tip clearance of 10 mils.

The desired rotor temperature, T', is determined by adding the change in T to T.

The temperature of the heat transfer fluid is now varied in order to attain the desired rotor temperature T'. More specifically, the amount of the heating fluid $w_h$ (fifth stage air) is varied to attain T'. First however, equation (6) must again be solved—this time for the required value of $T_{in}$ (hereinafter referred to as $T_{in}'$). Once $T_{in}'$ is known, the required $w_h$ is determined by solving the following equations:

$$w_c T_c + w_h T_h = w_b T_{in}' \quad (8)$$

$$w_b = w_c + w_h \quad (9)$$

where:

$w_c$ = booster air flow $w_h$ = 5th stage bleed air flow $w_b$ = bore flow $T_c$ = booster air temperature $T_h$ = 5th stage air temperature The valve position can then be automatically set to provide the required 5th stage flow thereby attaining the desired rotor temperature.

The present invention not only affects clearances in the high pressure compressor but also in the high pressure turbine and low pressure turbine. In the embodiment shown in FIG. 3, only the clearances in the two downstream stages of the low pressure turbine will be affected.

It will be clear to those skilled in the art that the present invention is not limited to the embodiment shown and described herein. For example, it may be possible to vary the temperature of $w_b$ by using more than two sources of air or by changing the temperature of a single source of air.

It should also be understood that the dimensions and proportional and structural relationships shown in the drawings are illustrated by way of example only and these illustrations are not to be taken as the actual dimensions or proportional structural relationships used in the present invention.

Numerous modifications, variations, and full and partial equivalents can be undertaken without departing from the invention as limited only by the spirit and scope of the appended claims.

What is claimed is:

1. A system for controlling the temperature of a rotor of a turbomachine comprising:

means for supplying a heat transfer fluid flow ($w_b$) to said rotor;

means for varying the temperature of $w_b$; and means for controlling said varying means as a function of the heat carrying capacity of $w_b$.

2. A system, as recited in claim 1, wherein said supply means includes:

means for supplying a flow of cooling fluid ($w_c$) to said rotor; and means for supplying a flow of heating fluid ($w_h$) to said rotor.

3. A system, as recited in claim 2, wherein said varying means includes means for varying $w_h$.

4. A system for controlling the temperature of a rotor of a turbomachine comprising:

means for supplying a flow of cooling fluid ($w_c$) to said rotor;

means for supplying a flow of heating fluid ($w_h$) to said rotor;

means for varying ($w_h$); and means for controlling said varying means;

wherein the total flow ($w_b$), $w_c+w_h$, remains relatively constant at a given operating condition of said turbomachine regardless of the flow rate of said heating fluid; and said control means includes means for calculating $w_h$ as a function of $w_b$.

5. A method for controlling the temperature of a rotor of a turbomachine comprising:

providing a heat transfer fluid flow ($w_b$) to said rotor;

calculating the rotor temperature as a function of $w_b$;

determining a desired rotor temperature; and varying the temperature of said heat transfer fluid to attain said desired rotor temperature.

6. A method for controlling the temperature of a rotor of a turbomachine comprising:

providing a source of heating fluid;

providing a source of cooling fluid;

providing a flow ($w_b$) of said heating and cooling fluids to said rotor, $w_b$ having a temperature ($T_{in}$);

calculating the rotor temperature (T) as a function of $w_b$;

determining a desired rotor temperature; and varying the amount of said heating fluid to attain said desired rotor temperature.

7. A method for controlling the temperature of a rotor of a turbomachine comprising:

providing a source of heating fluid;

providing a source of cooling fluid;

providing a flow ($w_b$) of said heating and cooling fluids to said rotor, $w_b$ having a temperature ($T_{in}$);

calculating the rotor temperature (T) as a function of $w_b$ according to the formula:

$$T=T_{in}+[N_u kA(T_s-T_a)]/r_d w_b c_p$$

where:

$N_u$ = the average Nusselt number k = air conductivity

A = heat transfer surface area of the rotor drum $T_s$ = average surface temperature $T_a$ = average bore air temperature $r_d$ = mean radius of said bore, and $w_b$ = bore flow;

wherein $N_u$ is determined experimentally for different operating conditions and $T_s$ is a reference temperature reflecting the heat input to said rotor;

determining a desired rotor temperature; and varying the amount of said heating fluid to attain said desired rotor temperature.

8. A method, as recited in claim 7, wherein $N_u$ is calculated according to the equation:

$$N_u=C\,R_x^l Gr^m Pr^y \qquad (2)$$

where:

$R_x$ is the axial through flow Reynolds number,

Gr is the Grashoff number,

Pr the Prandl number, and

C, l, m, and y are constants; wherein:

C, l, m, and y are determined experimentally.

9. A method, as recited in claim 8, wherein said turbomachine rotor is a compressor of a gas turbine engine and $T_{out}$ is the temperature at the outlet of said compressor.

10. A method for predicting an operating parameter within the bore of a gas turbine engine, said engine having a variable heat transfer fluid flow to said bore, comprising:

obtaining values, at a first engine operating condition, of altitude and internal bore operating parameters including rotor temperature, heat transfer fluid flow rate, and engine speed;

establishing a relationship between the heat transfer process and said variables; and calculating one of said variables at a second operating condition using said relationship.

11. A method, as recited in claim 10, wherein said calculated operating parameter is heat transfer fluid flow rate.

12. A method, as recited in claim 10, wherein said calculated operating parameter is rotor temperature.

• • • • •